US011492023B2

(12) United States Patent
Kress et al.

(10) Patent No.: US 11,492,023 B2
(45) Date of Patent: Nov. 8, 2022

(54) TRANSVERSE TROUGH COIL CAR AND SLAB CAR WITH INTEGRAL ADJUSTABLE LATERAL COIL STOPS, VERTICAL TROUGH HEIGHT ADJUSTMENT AND WIDTH ADJUSTABLE FIXED STANCHIONS

(71) Applicant: JAC Operations, Inc., Chicago, IL (US)

(72) Inventors: Michael H. Kress, Seward, PA (US); Cloyd Wirick, Mineral Point, PA (US)

(73) Assignee: JAC OPERATIONS, INC., Chicago, IL (US)

( * ) Notice: Subject to any disclaimer, the term of this patent is extended or adjusted under 35 U.S.C. 154(b) by 723 days.

(21) Appl. No.: 16/380,147

(22) Filed: Apr. 10, 2019

(65) Prior Publication Data

US 2020/0101987 A1 Apr. 2, 2020

Related U.S. Application Data

(60) Provisional application No. 62/655,330, filed on Apr. 10, 2018.

(51) Int. Cl.
*B61D 3/16* (2006.01)
*B61D 3/04* (2006.01)

(52) U.S. Cl.
CPC *B61D 3/16* (2013.01); *B61D 3/04* (2013.01)

(58) Field of Classification Search
CPC ..... B61D 3/16; B61D 3/04; B61D 45/003; B60P 7/12; B60P 3/077; B60P 7/0892; B60P 3/035
See application file for complete search history.

(56) References Cited

U.S. PATENT DOCUMENTS 1,098,103 A * 5/1914 Freschi ..... B62D 43/007 224/42.25
1,850,597 A 3/1932 McGuire
2,810,602 A * 10/1957 Abrams ..... B61D 45/003 280/789
3,481,627 A * 12/1969 Felburn ..... B60P 7/12 410/50
3,693,554 A 9/1972 O'Leary et al.
3,715,993 A * 2/1973 Orlik ..... B61D 45/003 410/48
4,451,188 A 5/1984 Smith et al.
(Continued)

FOREIGN PATENT DOCUMENTS

DE 10307598 A1 * 9/2004 ..... B60P 7/0892
WO 2013151996 10/2013

*Primary Examiner* — Mark T Le
(74) *Attorney, Agent, or Firm* — Blynn L. Shideler; Krisanne Shideler; BLK Law Group

(57) ABSTRACT

A transverse trough coil car includes a plurality of transverse troughs, a pair of trucks, a center sill supported on the trucks, a pair of side walls extending the length of the car coupled to the center sill, and a plurality of trough forming assemblies. At least one trough includes integrated manually operated adjustable coil stops configured to prevent lateral shifting of coils carried within the trough. At least one trough includes a vertically adjustable trough height. An upper surface of the troughs are coplanar for selective receipt of slabs, and at least one trough includes integrated fixed side stanchions which includes width adjustment members thereon.

19 Claims, 5 Drawing Sheets

(56) References Cited

U.S. PATENT DOCUMENTS

| | | | | | |
|---|---|---|---|---|---|
| 5,076,745 | A * | 12/1991 | Klein | B60P 7/08 | 410/94 |
| 5,622,116 | A * | 4/1997 | Carlton | B60P 3/035 | 296/25 |
| 6,439,131 | B1 * | 8/2002 | Higgins | B60F 1/00 | 206/508 |
| 6,543,368 | B1 | 4/2003 | Forbes | | |
| 6,679,187 | B2 * | 1/2004 | Dorian | B61D 3/16 | 105/404 |
| 2005/0226697 | A1 * | 10/2005 | Rediehs | B61D 3/16 | 410/49 |

* cited by examiner

TRANSVERSE TROUGH COIL CAR AND SLAB CAR WITH INTEGRAL ADJUSTABLE LATERAL COIL STOPS, VERTICAL TROUGH HEIGHT ADJUSTMENT AND WIDTH ADJUSTABLE FIXED STANCHIONS

FIELD OF THE INVENTION

The present application claims the benefit of U.S. Provisional Patent Application Ser. No. 62/655,330 filed Apr. 10, 2018 entitled "Transverse Trough Coil and Slab Car Railcars with Integral Adjustable Lateral Coil Stops, Vertical Trough Height Adjustment and Width Adjustable Fixed Stanchions."

FIELD OF THE INVENTION

The present invention relates to transverse trough coil and slab railcars with integral adjustable lateral coil stops, vertical trough height adjustment, and width adjustable fixed stanchions.

BACKGROUND OF THE INVENTION

Freight railroad cars are critical to the economic well-being and global competitiveness of any industrialized country. Essentially all goods are shipped by rail—everything from lumber to vegetables, coal to orange juice, grain to automobiles, and chemicals to scrap iron—because rail provides major advantages in energy efficiency over other modes. On average, railroads are three times more fuel efficient than trucks. Railroads are environmentally friendly as the U.S. Environmental Protection Agency (EPA) estimates that for every ton-mile, a typical truck emits roughly three times more nitrogen oxides and particulates than a locomotive. Other studies suggest trucks emit 6 to 12 times more pollutants per ton-mile than do railroads, depending on the pollutant measured. Railroads also have a clear advantage in terms of greenhouse gas emissions. According to the Environmental Protection Agency (EPA), railroads account for just 9 percent of total transportation-related NOx emissions and 4 percent of transportation-related particulate emissions, even though they account for 42 percent of the nation's intercity freight ton-miles.

Further, freight railroads significantly alleviate highway congestion. A single intermodal train takes up to 280 trucks (equivalent to more than 1,100 cars) off associated highways; a train carrying other types of freight takes up to 500 trucks off the associated highways. It has been noted that overcrowded highways act as an "inefficiency tax" on our economy, seriously constraining economic growth. Freight railroads help relieve this restriction by reducing gridlock, enhancing mobility, and reducing the pressure to build costly new highways.

Finally, railroads have major safety advantages over other modes. For example, railroads are the safest way to transport hazardous materials. In the United States, railroads and trucks carry roughly equal hazmat ton-mileage, but trucks have nearly 16 times more hazmat releases than railroads. Thus there is a need to continue to improve and revitalize the freight car industry. Focusing on improving railcar design can further increase the above identified advantages.

The present invention is related to coil and slab cars. Steel slabs are often shipped on a flat cargo bed car supported on a center sill. There have been specialty cars designed for both coils and slabs such as disclosed in the applicant's U.S. Pat. No. 6,679,878 which is incorporated herein by reference. As disclosed in the '878 patent, side slab stanchions are often included to restrain slabs hauled on a slab car.

Coil cars are a specialized type of railcars, or rolling stock designed primarily for the transport of coils (i.e., rolls) of sheet metal, most commonly steel coils (although not always exclusively used for transport of coils). Coil cars are often are considered a subtype of the gondola car, though coil cars bear little resemblance to a typical gondola. A gondola is generally an open-top type of rolling stock that is typically used for carrying loose bulk materials, while coil cars carry items such as plates or coils, or bulky items such as prefabricated pieces of rail track.

Prior to the development, and wide adoption, of coil cars, coils of sheet steel were carried on end or in cradles in open or covered gondolas. Load shifting, damage, and awkward loading and unloading were all problems with this type of loading, and since so much sheet steel is transported, a specialized car was designed for this use.

The body of a coil car consists of at least one trough, or a series of troughs, and may be lined with wood or other material to cushion the carried coils. The coils are set on their sides and supported by the sides forming the trough, and stops were often manually applied to keep the coils from shifting. Often the trough or pair of troughs are positioned longitudinal relative to the railcar as shown, for example, in U.S. Pat. Nos. 4,451,188 and 6,543,368, which are incorporated herein by reference.

The longitudinal placement of the troughs in a coil car results in coils being subjected to shifts in the trough due to the acceleration and deceleration and impact forces exerted due to the railcar motion along the track. Thus some coil cars are designed with the troughs transverse to the direction of travel such that the coils are carried with their axes transverse to the direction of travel of the car, and may be referenced as transverse coil cars. Representative examples of this construction include U.S. Pat. Nos. 1,850,597; 3,291,073 showing a coil skid design; U.S. Pat. No. 3,693,554 discloses a rail flat car with a plurality of transverse bulkheads; and U.S. Pat. No. 3,715,993 in which the cylindrical objects are cable reels. W0 2013/151996 of the applicant shows a modern transverse coil car. These patents and publication are also incorporated herein by reference.

Transverse coil cars typically have a number of parallel troughs, rather than one or two long trough(s). Each trough is generally V-shaped (sometimes a U-shape), and the coil sits in the transverse trough with the outer circumference of the coil tangent to the V at two points such that it cannot roll. There are restrictions on how high the contact point of a carried coil in an associated trough may be for safety concerns during transport. The V-shaped troughs are often lined, such as with wood decking to act as cushioning, thereby discouraging damage to the coils during loading or travel.

U.S. Pat. No. 2,810,602 discloses a trailer vehicle body which includes transverse laden supports and is also of general interest to the transverse coil rail car of the present invention.

There remains a need in the industry improve operating efficiencies of coil cars and increase the range of acceptable coils for a given transverse coil car and to allow a coil car to effectively transport coils or slabs.

SUMMARY OF THE INVENTION

One aspect of the present invention is directed to a transverse trough coil car which includes a plurality of transverse troughs along the car body and wherein at least one trough includes integrated manually operated adjustable coil stops configured to prevent lateral shifting of coils carried within the trough.

One aspect of the present invention is directed to a transverse trough coil car which includes a plurality of transverse troughs along the car body and wherein at least one trough includes a vertically adjustable trough height.

One aspect of the present invention is directed to a transverse trough coil and slab car which includes a plurality of transverse troughs along the car body and wherein an upper surface of the troughs is coplanar for selective receipt of slabs at least one trough includes integrated fixed side stanchions which includes width adjustment members thereon.

These and other advantages of the present invention will be described in connection with that attached figures in which like reference numeral represent like elements throughout.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE INVENTION

Figure 1:
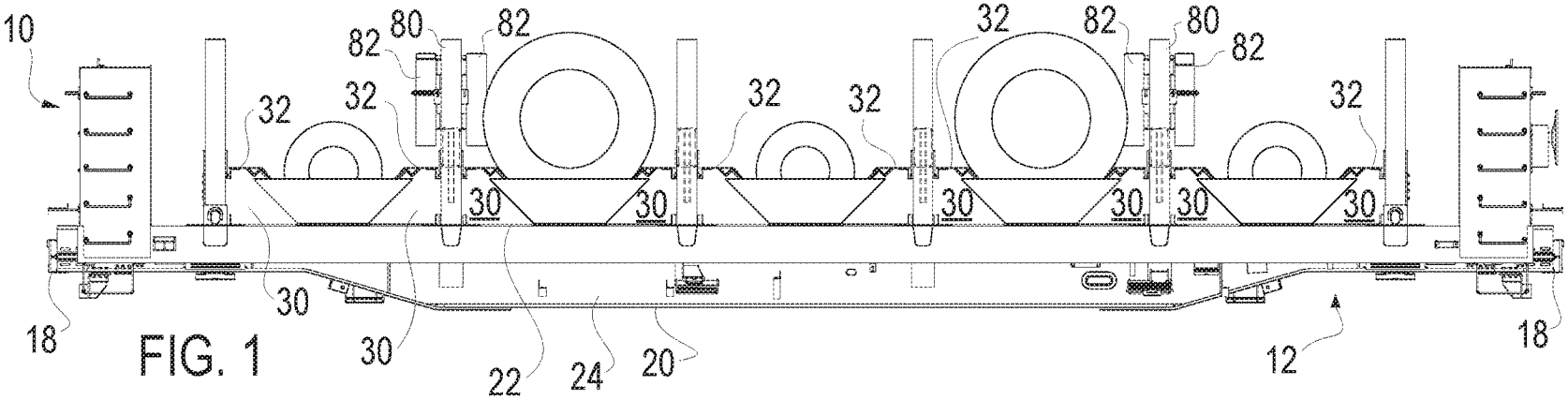
FIG. 1 is a side view of a transverse coil and slab railcar according to one aspect of the present invention.
Figure 2:
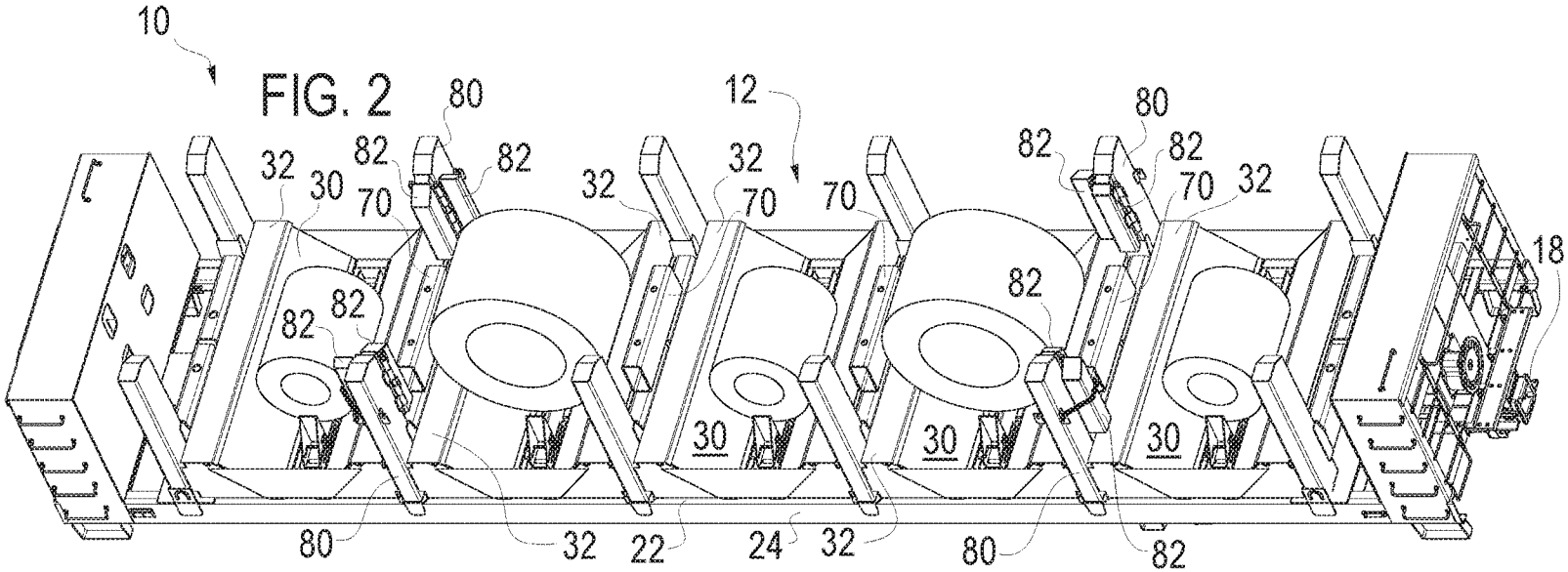
FIG. 2 is a top view of the transverse trough coil and slab railcar according to FIG. 1.

FIG. 1 is an elevational side view of a transverse coil and slab railcar 10, or simply car 10 ("railcar" and "car" are used interchangeably herein). This railcar 10 includes an open top body 12 on a pair of spaced trucks (not shown). The truck (also known as bogies), in railroading, references the railroad car wheel assembly usually having two or more axels and which typically rotate freely beneath the cars in order to allow the cars to navigate turns.

The body 12 includes a center sill 16 which is generally a box shaped in cross-section and may be considered the main structural member of the railcar 10. The center sill 16 runs from one draft arm and coupling 18, also known as coupler 18, at one end of the car 10 to the other coupling/coupler 18. The center sill 16 is the primary load path of the car 10 both for longitudinal buff and draft loads from coupler 18 to coupler 18, and for carrying the vertical load bending moment between the trucks. See examples of center sill 16 constructions in U.S. Pat. Nos. 7,861,659; 6,119,345; 5,860,366; 4,565,135; 4,493,266 and 4,194,451 which are incorporated herein by reference. The center sill 16 may be effectively a cold formed center sill or a fabricated sill or other known constructions.

Figure 9A:
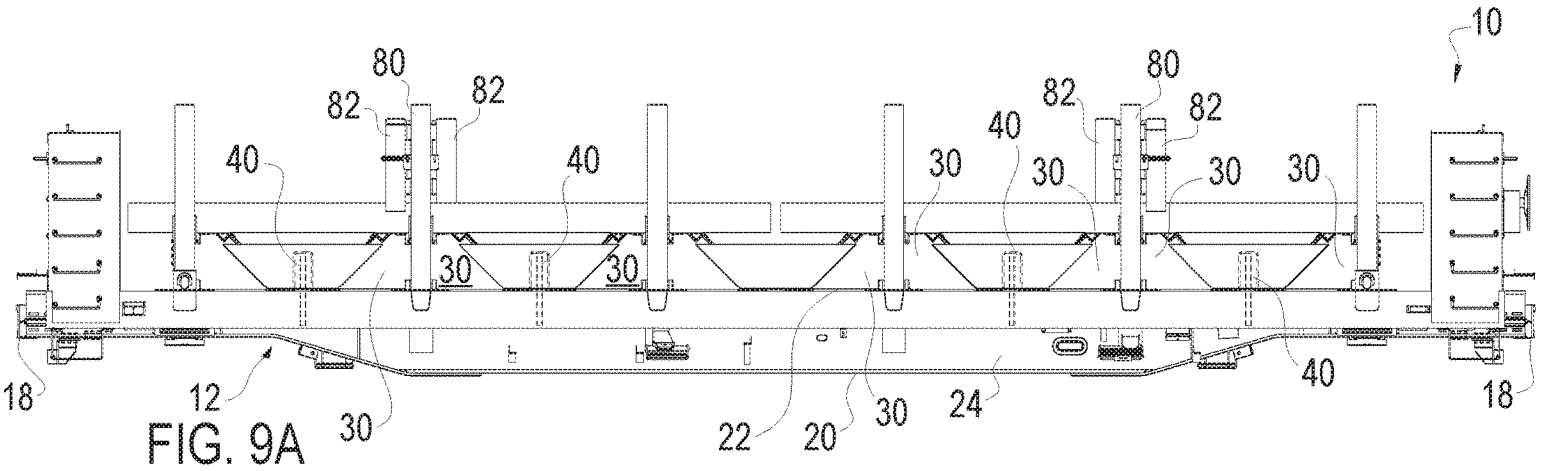
FIG. 9A is a side view of a transverse coil and slab railcar of FIG. 1 according to one aspect of the present invention illustrated for carrying slabs.
Figure 9B:
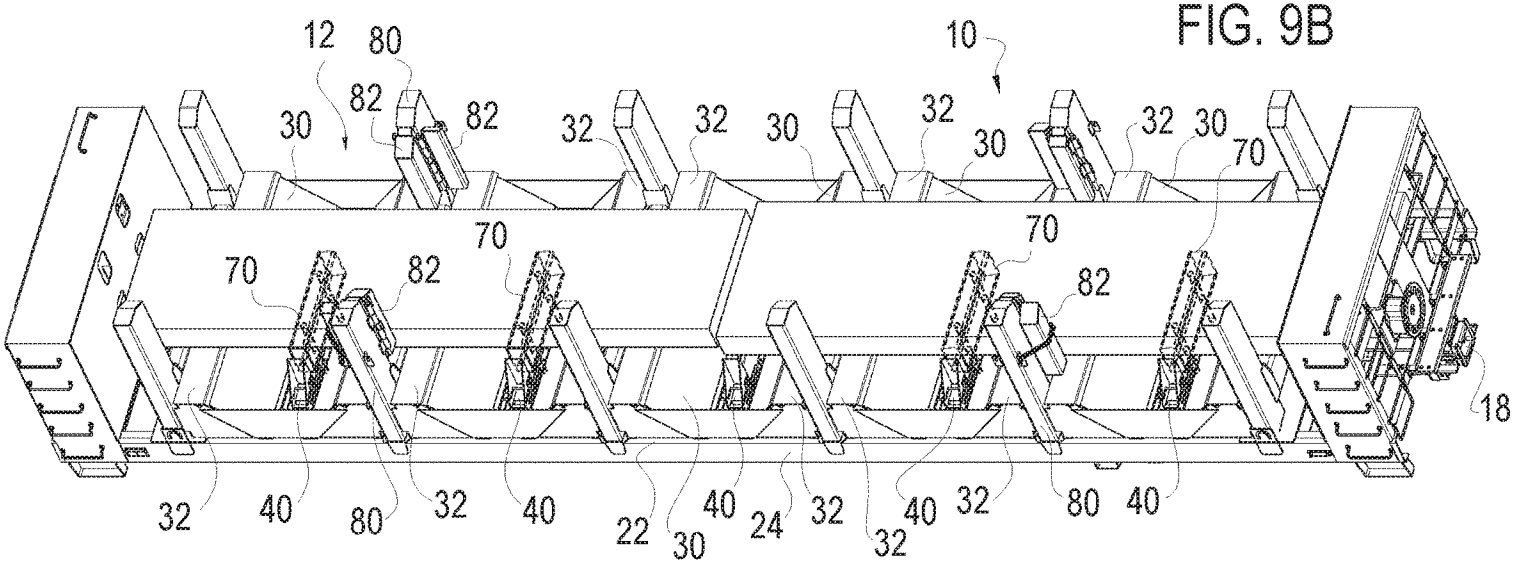
FIG. 9B is a perspective view of the transverse coil and slab railcar of FIG. 9A.

The body 12 includes a pair of side walls extending the longitudinal length of the car body 12 on opposed sides of the car 10, each side wall is a cold formed integrated side sill 20, top chord 22, and side plate 24. Alternatively separate top chord 22, side sill 20 and side plates 24 may be used and separate side stakes may be provided to further support the separate side plate 24. The integrated top chord-side plate-side sill construction of the side wall provides a one piece simple advantageous construction of light weight, The body 12 includes a plurality of transverse troughs 30 that are each designed around a specific range of coils. Each trough 30 may be formed by an assembly which includes a center cross bearer member, such as an I-Beam, extending between and coupled to the side walls and coupled to the center sill 16, a pair of angled floor plates and a top cap 32, or upper surface, extending between and coupled to the side walls. The angled floor plates of each trough forming assembly form the longitudinally fore and aft angled sections of adjacent troughs 30. A plurality of floor plate supporting gussets extending between the center cross bearer member and the pair of angled floor plates and the top cap 32. The troughs 30 may include other coil engaging structure (not shown) such as wood supports to protect the coils and car cover structures over the car body 12, which also protect the coils. The top caps 32 of each of the troughs 30 are coplanar to easily provide for slab carrying capacity for the car 10 as illustrated in FIGS. 9A and B.

Figure 3:
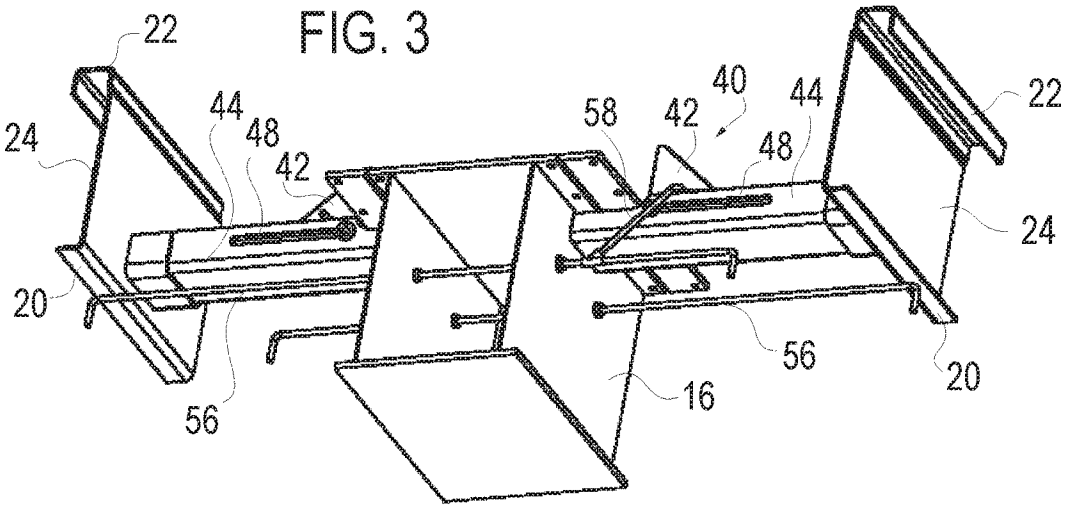
FIG. 3 is a perspective section view of one set of manually operated adjustable coil stops configured to prevent lateral shifting of coils carried within the trough according to the present invention for the coil and slab railcar of FIG. 1.
Figure 4:
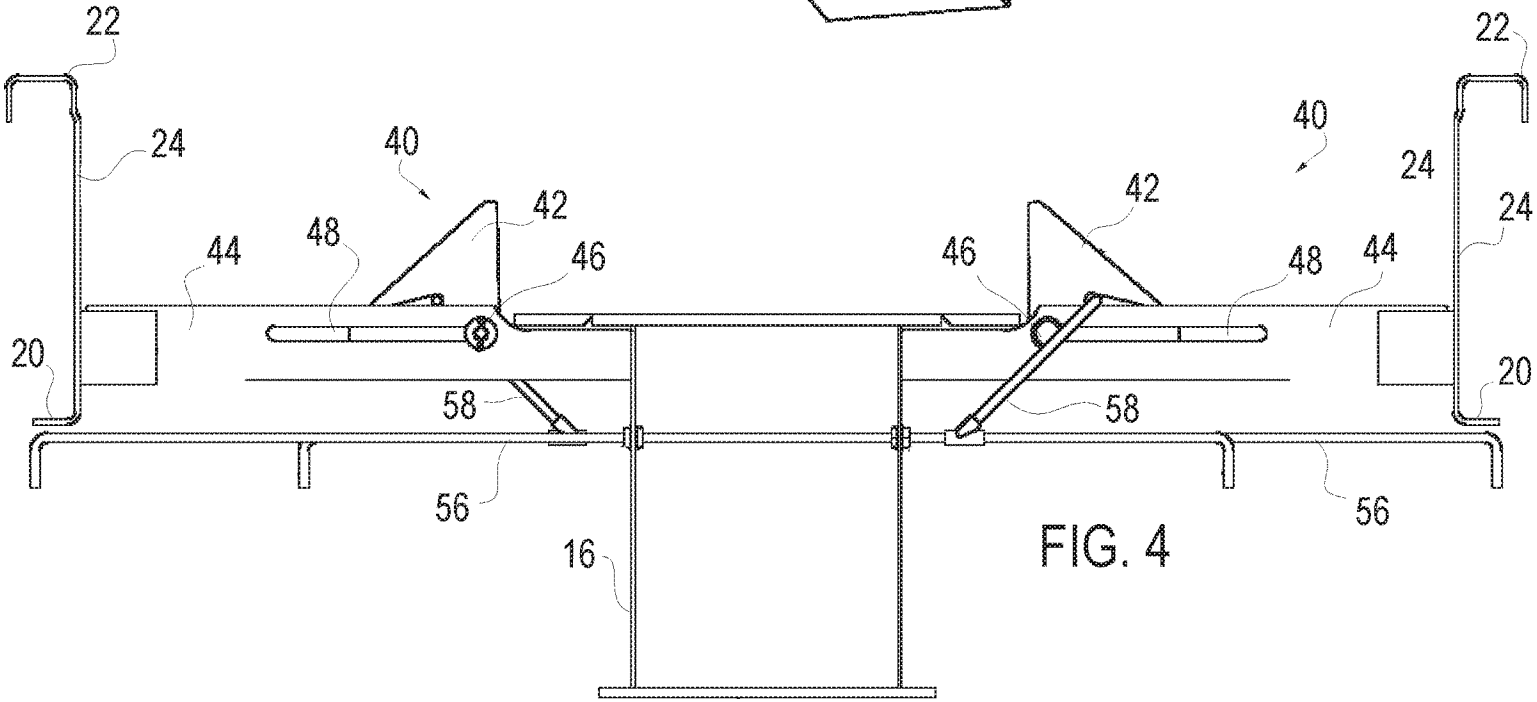
FIG. 4 is an elevational section view of the set of manually operated adjustable coil stops of FIG. 3.
Figure 6:
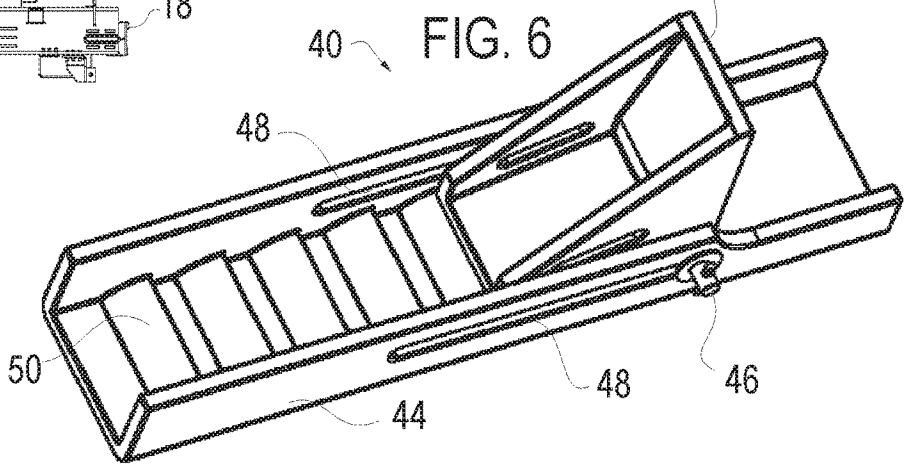
FIG. 6 is a perspective view of one of the set of manually operated adjustable coil stops of FIG. 3.
Figure 5:
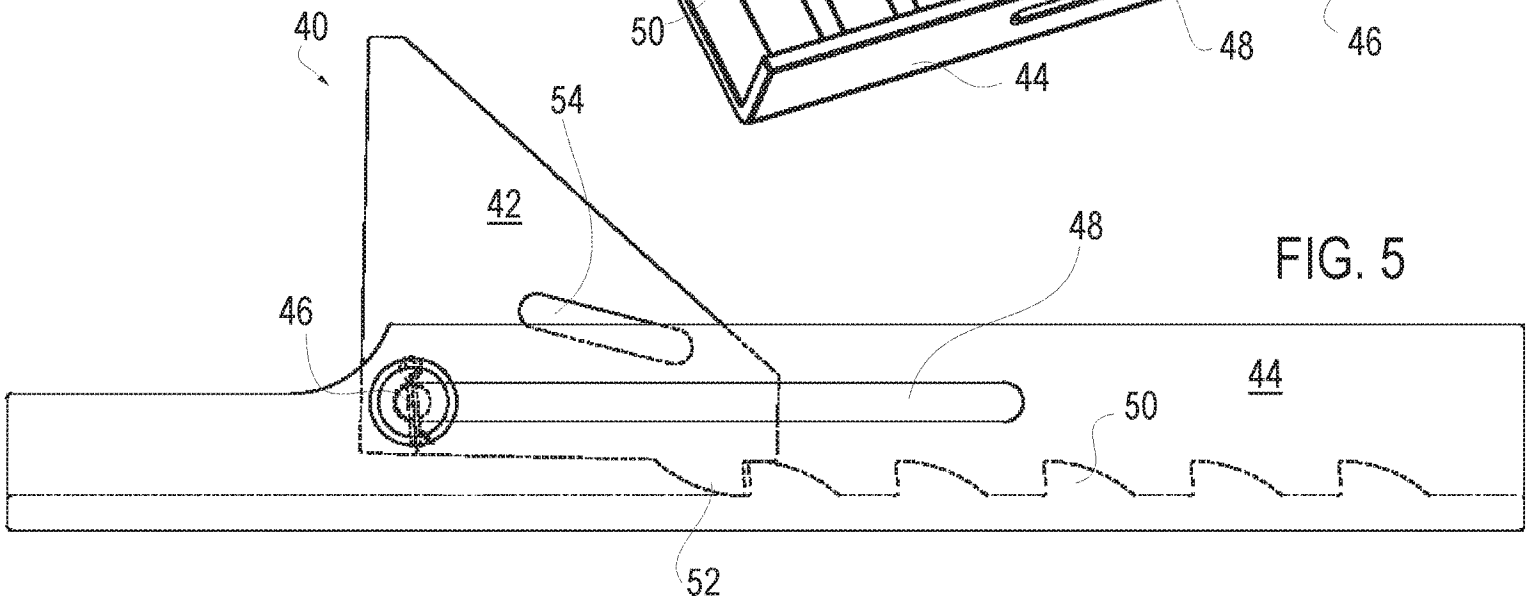
FIG. 5 is a side elevation view of one of the set of manually operated adjustable coil stops of FIG. 3.

A significant aspect of the present invention is the inclusion of a plurality of integrated manually operated adjustable coil stops 40, shown best in FIGS. 3-6, configured to prevent lateral shifting of coils carried within the trough 30. The manually operated adjustable coil stops 40 are integrated into the car 10 and include a manually moveable coil stop body 42 moving along a track 44 that is mounted to the center sill 16 and the integrated side sill 20—side plate 24—top chord 22 structure of the car 10 as shown in FIGS. 3-4. Specifically, the coil stop body 42 is pinned via pin coupling 46 to a slot 48 within the track 44, wherein the slot 48 defines the limit of the movement of the coil stop body 42.

The track 44 includes a plurality of ratchet teeth 50 that are selectively engaged by a pawl 52 coupled to the coil stop body 42. The teeth 50 are uniform but asymmetrical, with each tooth 52 having a moderate slope on one edge and a much steeper slope on the other abutting edge. When the coil stop body 42 is moving in the unrestricted (i.e., forward) direction toward the coil, the pawl 52 easily slides up and over the gently sloped edges of the teeth 50, with gravity forcing the pawl 52, often with an audible 'click', into the depression between the teeth 50 as it passes the tip of each tooth 52. When the coil stop body 42 attempts to move in the opposite (backward) direction via coil movement, however, the pawl 52 will catch against the steeply sloped edge of the first tooth 50 it encounters, thereby locking pawl 52 and coil stop body 42 against the tooth 50 and preventing any further motion in that direction, and providing lateral stability to the contained coil.

The coil stop body 42 includes an angled slot 54 to allow for the manual adjustment thereof. A handle 56, accessible for either side of the car 10, is mounted for manual movement of an associated coil stop body 42 with the handle 56 including an extension 58 extending to the angled slot 54. In operation when the handle 56 is moved to manually move the associated coil stop body 42 in the unrestricted (i.e., forward) direction toward the coil, the extension 58 will slide in angled slot 54 to the higher end proximal to the coil and then the coil stop body 42 will move in the forward direction with further handle 56 movement in that direction and the pawl 52 will easily slide up and over the gently sloped edges of the teeth 50, with gravity forcing the pawl 52, often with an audible 'click', into the depression between the teeth 50 as it passes the tip of each tooth 52. In operation, when the handle 56 is moved to manually move the associated coil stop body 42 in the restricted (i.e., backward) direction away from the coil, the extension 58 will slide in angled slot 54 to the lower end distal from to the coil which lifts the pawl 52 to position that is not engaged with the teeth 52 of the track 44 whereby then the coil stop body 42 will move in the rearward direction with further handle 56 movement in that direction.

The integrated manually operated adjustable coil stops 40 of the railcar 10 easily and quickly address the current problem of restraining the lateral movement of coiled products inside the troughs 30 of the transverse coil car 10. The prior solution was to use removable blocking to prevent lateral shifting of coiled steel during transport which has inherent problems including availability and accessibility of blocking materials, waste of blocking materials, storage for later use of blocking materials, excessive labor required to use/install blocking materials, etc. The integrated manually operated adjustable coil stops 40 removes these difficulties in a simple robust system.

The manually operated, gravity biased, ratcheting, integrated transverse coil car, coil stop 40 will easily restrain coiled steel products from lateral shifting which may occur during transport. It is easily operable from either side of the car 10 and is within reach from ground level which allows users to safely operate without mounting the car 10. The user will simply grasp the operating handle 56 for the associated coil stop body 42 and move coil stop body 52 to the desired location to secure the coil. The user can also, in single motion, disengage the coil stop body 42 and move the body 42 to the desired location in a backward direction.

Figure 7:
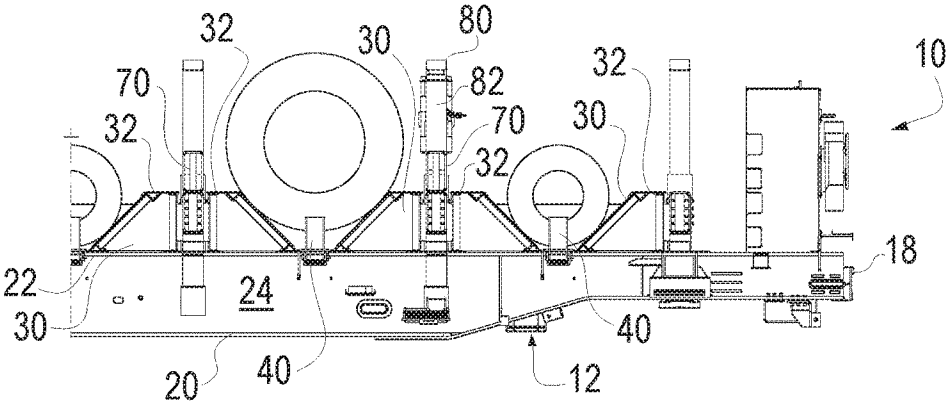
FIG. 7 is a section view of adjacent troughs one of which includes a vertically adjustable trough height according to the invention for the coil and slab railcar of FIG. 1.

One aspect of the present invention is best shown in FIG. 7 and is directed to the transverse trough coil car 10 which includes the plurality of transverse troughs 30 along the car body 12 and wherein each trough includes a vertically adjustable trough height. As known in the art a trough 30 of a coil car 10 is designed for a range of coils. AAR requirements demand that the engagement of the coil with the trough sides be a designated distance below the height of the trough 30. The trough 30 of the present invention include a height adjustable rail member 70 for each trough 30 as shown in FIGS. 7-8. With the adjustable rail member 70 present as shown in FIGS. 7-8 the trough 30 can accommodate the largest coil possible in the range of the specific trough 30, namely the rail member 70 provides the requisite height for the trough 30. However, a given user may be continuously hauling a smaller diameter set of coils wherein the added height of each trough 30 is not required, and the height of the trough 30 with the adjustable rail member 70 present as shown in FIGS. 7-8 can slow the loading process such that a lower profile trough 30 is desirable. The present invention provides vertically adjustable trough height via the adjustable rail member 70.

There are several alternatives for providing the desired adjustability via the adjustable rail member 70 in accordance with the present invention. The first is simply removing the adjustable rail member 70 from the top of the trough 30 to yield the lower profile configuration. The lower profile troughs 30 without the adjustable rail member 70 simply have a lower range of appropriate coils than does the troughs 30 with the rail members 70. The removable rail member 70 version represents a simple construction as the rail member 70 is merely added or removed as needed. In this configuration the railcar 10 may include one or two storage locations for the rail members 70 when not associated with the troughs 30, so the rail members 70 are maintained with the car 10 to allow the car 10 to easily be converted back to (some or all) of the full height troughs 30, and vice-versa. The storage location for the members 70 can be within the troughs 30 when the car 10 is used as a slab car as shown in FIGS. 9A and B, and likely would be along the sidewalls when using the low profile coil troughs 30 (i.e. the troughs 30 without the members 70) for coils.

Figure 8A:
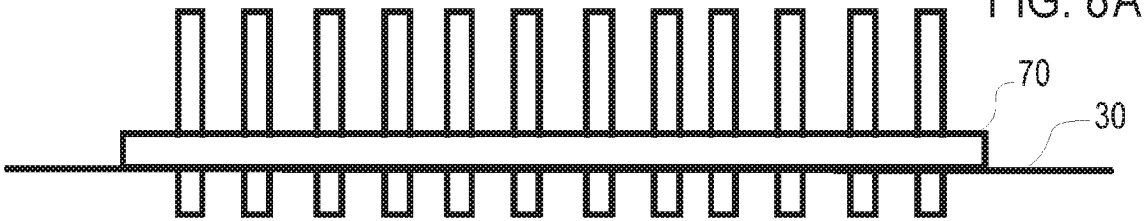
FIGS. 8A and B are schematic sectional views of an invertible rail member forming a vertically adjustable trough height according to the invention for the coil and slab railcar of FIG. 1.
Figure 8B:
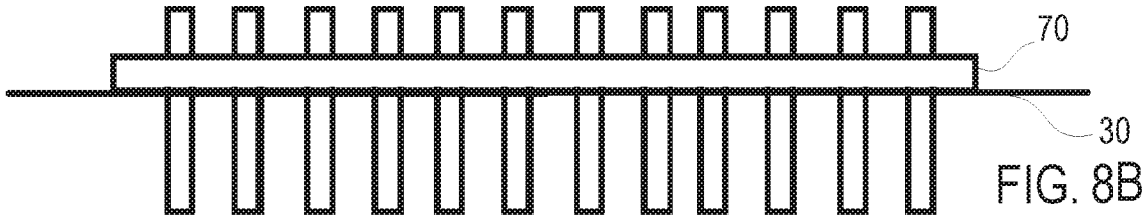

A second alternative for providing the desired adjustability via the adjustable rail member 70 in accordance with the present invention is an invertible rail member 70 on the top of the trough 30 shown in FIGS. 8A and B. In this embodiment the rail member 70 is installed on the top of the trough as shown in FIG. 8A to yield the full size trough 30. However, to yield the lower profile trough 30 configuration the invertible rail member 70 on the top of the trough 30 is removed and flipped over and reinstalled on the top of the trough 30 as shown in FIG. 8B. The inverted position of the rail member 70 shown in FIG. 8B yields a lower profile troughs 30 has a lower range of appropriate coils than does the troughs 30 with the rail members 70 in the original position of FIG. 8A, but the lower profile may speed and simplify loading. The inverted rail member 70 version also represents a simple construction as the rail member 70 is merely flipped as needed. In this configuration the railcar 10 may or may not include a storage location for the rail members 70 as the invertible rail members 70 are maintained with the trough 30 in both configurations for the coil car. The inverted rail member 70 may form a slab engaging surface for hauling slabs in one orientation, preferably the lower height, by providing a slab engaging coplanar surface, and in such a use the member 70 may be stored in a remote location, like in the trough 30 as shown in FIGS. 9A and B, when hauling slabs.

The rail members 70 for each trough 30, like the coil stop bodies 42, can be independently individually adjusted as needed and need not be uniform for the entire car 10, thus the car can have a low profile troughs 30 without the members 70 and high profile troughs 30 with members 70 intermittent in the same car 10 configuration.

The car 10 further includes width adjustable width fixed stanchions 80 that are used in slab carry mode as shown in FIGS. 9A and B. The stanchions are fixed in that they are carried with the car 10 at all times. At least one pair of stanchions 80, and preferably at least two as shown, includes width adjustment for slab products of varied widths. The width adjustment for adjustable fixed stanchions 80 is via a pair of hinged stabilizers 82 of varying depths. The stanchion 80 has a nominal spacing for one slab width with both stabilizers 82 in a stored or lateral position. One or the other stabilizer 82 can be pivoted into engagement to adjust the effective width of the pair of adjustable fixed stanchions 80.

A preferred embodiment has been described in detail and a number of alternatives have been considered. As changes in or additions to the above described embodiments may be made without departing from the nature, spirit or scope of the invention, the invention is not to be limited by or to those details, but only by the appended claims and equivalents thereto.

What is claimed is:

1. A transverse trough coil railcar comprising:

a car body including a center sill and a pair of side walls extending the longitudinal length of the car body, a plurality of transverse troughs along the car body, and a plurality of integrated manually operated adjustable coil stops, each manually operated adjustable coil stop mounting within one trough and which are configured to prevent lateral shifting of coils carried within the trough, wherein each manually operated coil stop includes a manually moveable coil stop body moving along a track extending between and mounted to the center sill and one of the side walls.

2. The transverse trough coil car according to claim 1 wherein the track of each manually operated coil stop is U-shaped and wherein a handle is provided that is accessible below the trough for manually moving the manually moveable coil stop body along the U-shaped track.

3. The transverse trough coil car according to claim 2 wherein each manually operated coil stop provides wherein the coil stop body is pinned via pin coupling to a pair of slots within side walls of the U-shaped track, and wherein the slots define a limit of the moving of the coil stop body along the U-shaped track.

4. The transverse trough coil car according to claim 3 wherein each manually operated coil stop provides wherein the U-shaped track includes a plurality of ratchet teeth on a base of the U-shaped track that are selectively engaged by a pawl coupled to the coil stop body.

5. The transverse trough coil car according to claim 4 wherein each manually operated coil stop is configured wherein when the coil stop body is moving in an unrestricted direction toward the coil, the pawl easily slides up and over the edges of the teeth.

6. The transverse trough coil car according to claim 5 wherein each manually operated coil stop is configured wherein gravity is forcing the pawl into a depression between adjacent teeth as it passes a tip of each tooth.

7. The transverse trough coil car according to claim 6 wherein each manually operated coil stop is configured wherein the coil stop body includes an angled slot to allow for the moving of the coil stop body along the U-shaped track.

8. The transverse trough coil car according to claim 7 wherein the handle of each manually operated coil stop includes an extension extending to the angled slot.

9. The transverse trough coil car according to claim 1 wherein at least one trough includes a vertically adjustable trough height.

10. The transverse trough coil car according to claim 9 wherein each trough having vertically adjustable trough height includes at least one height adjustable rail member.

11. The transverse trough coil car according to claim 9 wherein each trough having vertically adjustable trough height includes at least one invertible rail member on the top of the trough.

12. The transverse trough coil car according to claim 11 wherein each invertible rail member when installed on the top of the trough in a first position yields a first trough height and when installed in an inverted position yields a different trough height.

13. The transverse trough coil car according to claim 10 wherein the railcar includes remote storage for each height adjustable rail member when the rail member is not installed on the trough.

14. The transverse trough coil car according to claim 1 wherein upper surfaces of the troughs are coplanar for selective receipt of slabs and at least one trough includes integrated fixed side stanchions which includes width adjustment members thereon.

15. A transverse trough coil railcar comprising:

a car body including a center sill and a pair of side walls extending the longitudinal length of the car body, a plurality of transverse troughs along the car body, each trough formed by an assembly which includes a center cross bearer member extending between and coupled to the side walls and coupled to the center sill, a pair of angled floor plates and an upper surface, extending between and coupled to the side walls, and wherein a plurality of the troughs includes a vertically adjustable trough height, wherein each trough having vertically adjustable trough height includes at least one invertible rail member on the upper surface of the trough, wherein each invertible rail member includes a base member with projecting members of a first length extending in a first direction and projecting members of a second length extending in a second direction whereby when installed on the top of the trough in a first position yields a first trough height based upon the projecting members of the first length and when installed in an inverted position yields a different trough height based upon the projecting members of the second length.

16. The transverse trough coil car according to claim 15 wherein the railcar includes remote storage for each height adjustable rail member when the rail member is not installed on the trough.

17. The transverse trough coil car according to claim 15 wherein the upper surfaces of the troughs are coplanar for selective receipt of slabs and at least one trough includes integrated fixed side stanchions which includes width adjustment members thereon.

18. The transverse trough coil car according to claim 15 wherein an at least one of the troughs includes manually operated adjustable coil stops in at least one trough which are configured to prevent lateral shifting of coils carried within the trough.

19. A transverse trough coil and slab railcar comprising:

a car body including a center sill and a pair of side walls extending the longitudinal length of the car body, a plurality of transverse troughs along the car body, each trough formed by an assembly which includes a center cross bearer member extending between and coupled to the side walls and coupled to the center sill, a pair of angled floor plates and an upper surface, extending between and coupled to the side walls, and wherein the upper surfaces of the troughs are coplanar for selective receipt of slabs, and a plurality of the troughs includes a pair of integrated fixed side stanchions, wherein each of the fixed side stanchions of the pair of fixed stanchions which includes width adjustment members thereon, wherein each of the width adjustment members is pivoted to one of the fixed side stanchions about a pivot axis that is perpendicular to the plane defined by the co-planar top surfaces.

* * * * *